US012708183B2

(12) United States Patent
Lee et al.

(10) Patent No.: US 12,708,183 B2
(45) Date of Patent: Aug. 18, 2026

(54) JEWELRY CLASP POSITIONING DEVICE AND RELATED METHODS

(71) Applicants: Kelsey Lee, Johnston, IA (US); Michael Lee, Johnston, IA (US)

(72) Inventors: Kelsey Lee, Johnston, IA (US); Michael Lee, Johnston, IA (US)

(73) Assignee: CLASP'D LLC, Johnston, IA (US)

( * ) Notice: Subject to any disclaimer, the term of this patent is extended or adjusted under 35 U.S.C. 154(b) by 153 days.

(21) Appl. No.: 18/737,060

(22) Filed: Jun. 7, 2024

(65) Prior Publication Data

US 2024/0407511 A1 Dec. 12, 2024

Related U.S. Application Data

(60) Provisional application No. 63/506,668, filed on Jun. 7, 2023.

(51) Int. Cl.
*A44C 25/00* (2006.01)
*A44C 5/00* (2006.01)
*A44C 5/20* (2006.01)

(52) U.S. Cl.
CPC ..... *A44C 5/2014* (2013.01)

(58) Field of Classification Search
CPC ... Y10T 24/33; A44C 5/2014; A44C 15/0005; A44C 15/00; Y10S 63/01
See application file for complete search history.

(56) References Cited

U.S. PATENT DOCUMENTS

D289,388 S 4/1987 Gatsos
4,665,594 A 5/1987 Wagner
D294,335 S 2/1988 Gatsos
5,279,132 A 1/1994 Swaim
D557,633 S 12/2007 Ohgaku et al.
8,205,306 B2 6/2012 Kovach et al.
D674,318 S 1/2013 Chuan
9,602,640 B1 * 3/2017 Ham ..... H04M 1/0258
10,722,007 B2 * 7/2020 Upson-Tyler ..... A44C 15/0005
(Continued)

FOREIGN PATENT DOCUMENTS

GB 90010470210001 12/2008

OTHER PUBLICATIONS

International Searching Authority, "International Search Report and Written Opinion" From Application No. PCT/US2024/032971, Mailed Nov. 14, 2024, pp. 12.
(Continued)

*Primary Examiner* — Jack W Lavinder
(74) *Attorney, Agent, or Firm* — Fredrikson & Byron, P.A.

(57) ABSTRACT

The present invention is directed to a jewelry clasp positioning device. The jewelry clasp positioning device is a patch including a first face and a second face. The first face has an area and an adhesive layer. A first fastener is attached to the patch. A second fastener is attached to the patch. The device can be used by selecting a color of the jewelry clasp positioning device. Next, a user attaches a first and second fastening component of a piece of jewelry to the first and second fastener of the device and removes an adhesive cover. Next, the user aligns the first face of the jewelry clasp positioning device with a user's neck. Lastly, the user places the first face of the jewelry clasp positioning device against their neck.

20 Claims, 4 Drawing Sheets

(56) References Cited

U.S. PATENT DOCUMENTS

| | | | | |
|---|---|---|---|---|
| 10,731,698 | B2 | 8/2020 | Chmelar | |
| 11,596,208 | B2 | 3/2023 | Hashimoto | |
| D1,022,194 | S | 4/2024 | Keach | |
| 2010/0078541 | A1 | 4/2010 | Fathi et al. | |
| 2010/0229356 | A1 | 9/2010 | Larocque | |
| 2019/0113156 | A1* | 4/2019 | Herbert | F16L 3/13 |
| 2020/0000186 | A1 | 1/2020 | Hansen | |
| 2020/0253338 | A1 | 8/2020 | Hashimoto | |
| 2021/0068507 | A1* | 3/2021 | Patrzyk | A44C 5/185 |
| 2021/0361037 | A1 | 11/2021 | Barnard et al. | |
| 2022/0039524 | A1 | 2/2022 | Daga et al. | |
| 2024/0130489 | A1 | 4/2024 | Barnard et al. | |
| 2024/0407511 | A1 | 12/2024 | Lee et al. | |
| 2025/0386908 | A1 | 12/2025 | Lee et al. | |

OTHER PUBLICATIONS

StudioCult Earrings, published on (May 23, 2024) on instagram.com, retrieved from internet (Jan. 23, 2026). <URL: https://www.instagram.com/p/C3tEA4NPcpn/> (Year: 2024).

* cited by examiner

JEWELRY CLASP POSITIONING DEVICE AND RELATED METHODS

CROSS-REFERENCE TO RELATED APPLICATION(S)

This application claims the benefit under 35 U.S.C. § 119 (e) to U.S. Provisional Application 63/506,668, filed Jun. 7, 2023, and entitled NECKLACE CLASP POSITIONING DEVICE, which is hereby incorporated herein by reference in its entirety.

FIELD

The various embodiments herein relate to devices for the positioning of jewelry clasps when jewelry is worn by a user, including for the purpose of ensuring that the clasp remains disposed in a desired location on the user's neck.

BACKGROUND

Many necklaces include clasps that attach the ends of a necklace together. There are many types of clasps, such as spring rings and lobster claws, for example. These clasps are typically attached to the two ends of a necklace chain to connect those two ends. When the two clasps are connected, the necklace can be hung around a user's neck. When a necklace is worn, the necklace clasp is typically intended to sit at the rear of a user's neck.

Sometimes, the clasp of the necklace can drift while the necklace is worn by a user as a result of the necklace moving in relation to the user's neck. More specifically, the clasp can rotate about one's neck, bringing the clasp to the front of the neck, which is typically undesirable for the user.

There is a need in the art for a device that maintains a position for a necklace clasp at a user's desired location.

BRIEF SUMMARY

Discussed herein are various embodiments relating to jewelry clasp positioning devices and related methods of use. The devices can include a body and/or patch and attachment structures or openings to attach a jewelry fastener thereto. The patch can include an adhesive layer configured to attach the device to a surface.

In Example 1, a jewelry clasp positioning device comprises a patch comprising a first face and a second face, an adhesive layer coupled to the first face, a first fastener attached to the patch on a first side, and a second fastener attached to the patch on a second side, wherein the adhesive layer is configured to be placed on the skin of a user and not be removed during use.

Example 2 relates to the jewelry clasp positioning device of Example 1, wherein the adhesive layer is disposed on at least a portion of the first face.

Example 3 relates to the jewelry clasp positioning device of Example 1, wherein the first fastener and the second fastener are configured to attach to a jewelry fastener assembly.

Example 4 relates to the jewelry clasp positioning device of Example 1, wherein the first fastener and second fastener are attached to an attachment structure protruding outwardly from a perimeter of the patch.

Example 5 relates to the jewelry clasp positioning device of Example 4, wherein the attachment structure is located on the second face of the jewelry clasp positioning device.

Example 6 relates to the jewelry clasp positioning device of Example 4, wherein the first fastener is attached to a first attachment structure attached to a first edge of the patch and the second fastener is attached to a second attachment structure attached to a second edge of the patch.

Example 7 relates to the jewelry clasp positioning device of Example 1, wherein the jewelry clasp positioning device is a color that can be selected from a group consisting of at least one of gold, rose gold, and silver.

Example 8 relates to the jewelry clasp positioning device of Example 1, wherein the patch comprises a flexible plastic.

Example 9 relates to the jewelry clasp positioning device of Example 1, further comprising at least three first fasteners and at least three second fasteners.

Example 10 relates to the jewelry clasp positioning device of Example 9, wherein the at least three first fasteners are each located on a first side of the device and the at least three second fasteners are located on a second side of the device.

In Example 11, a jewelry clasp positioning device comprises a patch comprising a first face, a second face, a first end, and a second end, an adhesive layer disposed on the first face, a first opening extending through the patch from the first face to the second face at the first end of the patch, a second opening extending through the patch from the first face to the second face adjacent to the second end of the patch and configured to receive a clasp of a piece of jewelry, wherein the adhesive layer is configured to adhere to a user's skin during use.

Example 12 relates to the jewelry clasp positioning device of Example 11, wherein at least one of the first and second opening comprise a slot extending from the first face to the second face from at least one of the first and second opening to a perimeter of the patch.

Example 13 relates to the jewelry clasp positioning device of Example 11, wherein the adhesive layer is disposed on at least a portion of the first face.

Example 14 relates to the jewelry clasp positioning device of Example 11, wherein the first opening comprises a clasp.

Example 15 relates to the jewelry clasp positioning device of Example 12, further comprising a first device end and a second device end, and wherein the first end comprises a first hook and a second hook each disposed adjacent to one another at a distance from one another forming a passage to facilitate movement of a jewelry clasp therethrough.

Example 16 relates to the jewelry clasp positioning device of Example 15, wherein the first and second hook are configured to receive a jewelry clasp ring.

In Example 17, a method of using a jewelry clasp positioning device comprises selecting a color of the jewelry clasp positioning device, attaching a first and second fastening component of a piece of jewelry to the first and second fastener of the device, removing an adhesive cover, aligning the first face of the jewelry clasp positioning device with a location, and attaching the first face of the jewelry clasp positioning device to the location. The jewelry clasp positioning device comprises a patch including a first face and a second face, wherein the first face comprises an adhesive layer, a first fastener attached to the patch, and a second fastener attached to the patch.

Example 18 relates to a method of using a jewelry clasp positioning device of Example 17, wherein the adhesive layer is disposed on at least a portion of the first face.

Example 19 relates to a method of using a jewelry clasp positioning device of Example 17, wherein the jewelry clasp positioning device further comprises at least three first fasteners and at least three second fasteners, and wherein the first fastener and second fastener are attached to the patch using an attachment structure protruding outwardly from the patch.

Example 20 relates to a method of using a jewelry clasp positioning device of Example 17, wherein the location comprises a user's neck.

BRIEF DESCRIPTION OF THE DRAWINGS

The following drawings are illustrative of particular examples of the present invention and therefore do not limit the scope of invention. The drawings are not necessarily to scale, though embodiments can include the scale illustrated, and are intended for use in conjunction with the explanations in the following detailed description wherein like reference characters denote like elements. Examples of the present invention will hereinafter be described in conjunction with the appended drawings.

DETAILED DESCRIPTION

The various embodiments herein relate to devices for positioning or stabilizing a piece of jewelry on the body of a user such that the jewelry does not rotate in relation to the user's body, including to prevent the clasp from being positioned in front of the user's neck/body. Certain implementations include an attachable patch (with associated attachment devices, such as clasps) that can be adhered to the user's body at a desired location (such as the back of the user's neck) to prevent such necklace rotation.

Figure 1:
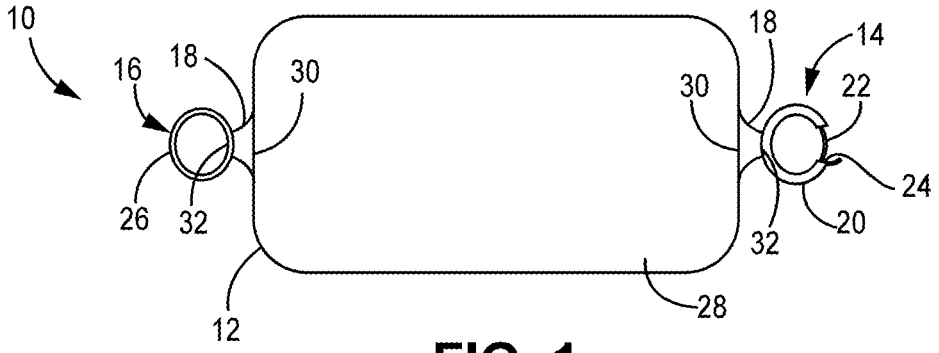
FIG. 1 is a front view of an embodiment of a jewelry clasp positioning device including two fastening components, in accordance with one or more examples of this disclosure.

FIG. 1 shows one exemplary embodiment of a necklace clasp positioning device 10. The necklace clasp positioning device 10 can comprise a body (also referred to as a "patch") 12 with appropriate fasteners attached thereto as described below. While the necklace clasp positioning device 10 is described herein with applications pertaining to necklaces, the clasp positioning device 10 could be used with any jewelry including a clasp. For example, the clasp positioning device 10 could be a bracelet clasp positioning device. Some embodiments of the clasp positioning device 10 can be used with bracelets, earrings, or any other jewelry. The patch 12 can have a first (or "contact") face 29 and a second (or "outer") face 28 such that the first face 29 may be in contact with and attachable to a user's body as will be described in additional detail below. The second face 28 is opposite to the first face 29.

In certain implementations, the first face 29 has an adhesive layer 31 disposed on the contact face 29 such that the adhesive layer 31 adheres the contact face 29 to a user's body in a desired location. For example, in some embodiments, the device 10 can be adhered to a desired location of a user (e.g., the user's neck, shoulders, wrist, ankle, or any other appropriate place on the user and/or the user's clothing to adhere the clasp positioning device). In certain examples, the adhesive layer 31 may cover the entirety of the first face 29. In other examples, the adhesive layer 31 may cover only a portion of the first face 29. The adhesive layer can be made of a skin adhesive material, such as tape, or any material that can safely adhere to skin. The adhesive layer may be designed to stick to or attached to a user's skin such that during normal use (e.g., as the user is wearing and/or displaying the jewelry) the patch remains in place. It is only when the jewelry is desired to be taken off that the user may remove the adhesive from the skin by pulling it off without damaging the user's skin.

The body or patch 12 can have a variety of features. For example, the patch 12 can have one of a variety of shapes. More specifically, in the embodiment shown, the patch 12 is substantially rectangular. In some embodiments, the rectangular patch 12 can have rounded corners or, alternatively, the patch 12 can have square, hexagonal, or any other desired corner shape). In other embodiments, the patch 12 can be a square, circular, triangular, or any other known shape. The patch 12 in certain implementations can be made of a flexible plastic. For example, in one specific example, the patch 12 is made of a flexible plastic with a silver coloring or appearance. Alternatively, the patch 12 can be made of a flexible plastic with a gold, rose gold, or plated stainless steel coloring or appearance. In a further implementation, the body 12 can be made of any known flexible material that can be attachable to a user's skin and can have any known coloring or appearance to replicate, match, or mimic the color of the jewelry with which the patch 12 is used. In some embodiments, the patch 12 can be made of metal. The patch 12 may be sufficiently flexible such that the patch 12 can bend along its length and width to follow the natural curve of a user's neck, back or other area of the user's body.

In accordance with certain embodiments, the patch 12 can have a length ranging from about 0.5 cm to about 3 cm and a width ranging from about 0.25 cm to about 3 cm. Such dimensions are exemplary; the patch 12 can includes length and widths larger or smaller than the dimensions listed herein. Further, in some implementations, the outer face 28 of the patch 12 can come in multiple different colors or surfaces to match the color or metal of the necklace with which the device 10 will be used. For example, in certain embodiments, the outer face 28 can have a gold color or a surface that simulates gold metal to match, or nearly match, a gold necklace to which the device 10 is to be attached during use. Alternatively, the outer face 28 can be any known color or simulated surface to match, or nearly match, any known necklace metal or color (such as gold, silver, gold and silver, rose gold, platinum, or any other known metal or color and any known combination thereof). Further, the outer face 28 can have two or more colors or simulated surfaces to match, or nearly match, any known necklace having two or more metals or colors (such as a combination of gold and silver, for example). Thus a variety of different devices 10 having different colors or simulated metals can be available to a user such that the user can select a device 10 to match the necklace the user wishes to wear.

As will be described in additional detail below, the necklace clasp positioning device 10 can connect to a necklace 70 via the attachment components provided on the device 10. More specifically, according to one embodiment, the necklace clasp positioning device 10 has a first fastener 14 and a second fastener 16 attached to the patch 12. The first fastener 14 and second fastener 16 can be configured to correspond to standard necklace fasteners 74, 76 found at opposite ends of a necklace 70, as will be discussed in further detail below. More specifically, the first fastener 14 in certain embodiments is a standard, known spring ring 20 or lobster clasp that operates in a known fashion. Alternatively, the first fastener 14 can be any known actuable fastener for use on necklaces. Similarly, the second fastener 16 in certain implementations is a standard known ring 26 for coupling with a known spring ring or lobster clasp. Alternatively, the second fastener 16 can be any known fixed fastener that couples with any known actuable fastener.

Thus, the two fasteners may be configured to accommodate any different known necklace clasps. These include bayonet clasps, barrel clasps, box clasps, figure-8 safety clasps, toggle clasps, s-hook clasps, mystery clasps, magnetic clasps, hook-and-eye clasps, snap clasps, pearl clasps, and any other known jewelry clasps.

Some embodiments of the necklace clasp positioning device can have additional features. For example, in certain implementations such as the exemplary version depicted in FIG. 1, both of the first fastener 14 and second fastener 16 have fastener attachment structures 18 that facilitate attachment of the fasteners 14, 16 to the patch 12. The attachment structures 18 can be the same material and/or color as the fasteners 14, 16. Alternatively, the attachment structures 18 can be made of any known material for use in ensuring attachment of the fasteners 14, 16 to the patch 12. Further, the attachment structures 18 can have a rectangle, square, or trapezoidal shape, or any other known shape. In certain implementations, the attachment structure 18 can have a first end 30 and a second end 32, with the first end 30 of the attachment structure 18 having a width that is greater than the width of the second end 32. Alternatively, the first end 30 and the second end 32 of the attachment structure 18 can have the same width. In accordance with some aspects, the first end 30 is attached to the patch 12, and the second end 32 is attached to the first fastener 14 or second fastener 16. In some embodiments, the attachment structure 18 can protrude outwardly from the patch 12. In other embodiments, the attachment structure 18 can protrude upwardly from the patch 12. In further implementations, the attachment structure 18 can protrude outwardly and upwardly from the patch 12.

Figure 2:
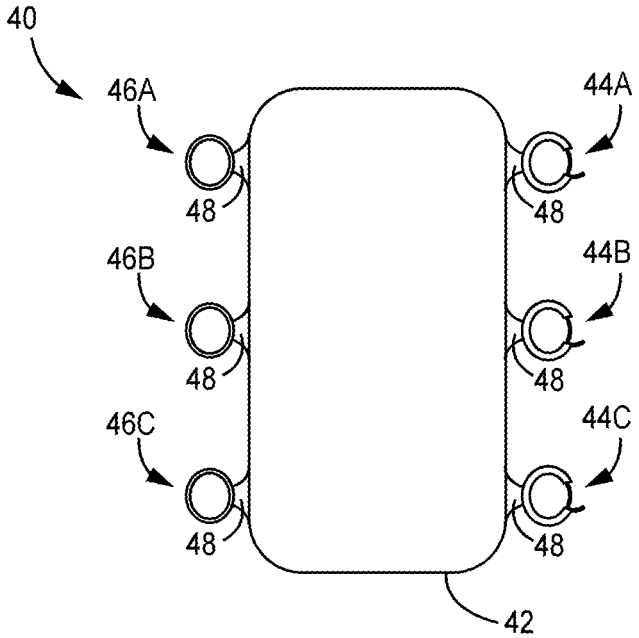
FIG. 2 is a front view of an embodiment of a jewelry clasp positioning device including six fastening components, in accordance with one or more examples of this disclosure.

FIG. 2 depicts a different embodiment of a necklace clasp positioning device 40 that can be used with multiple necklaces. In some embodiments, the device 40 can have two or more first fasteners 44A, 44B, 44C and two or more second fasteners 46A, 46B, 46C attached to the patch 42. The device 40 can have an elongated shape or a rectangular, square, triangular, a circle, or any other known shape.

As shown in FIG. 2, multiple fasteners can be attached to or integral with the device 40. That is, the two or more fasteners 44A-C, 46A-C can be positioned on the first and second sides of the patch 42. When worn by a user, the first and second sides of the patch 42 can be the left and right sides of the patch 42 as viewed in FIG. 2. A first fastener 44A and second fastener 46A can be located in an upper portion of the left side and right side of the patch 42. An additional first fastener 44B and second fastener 46B can be located at an approximate center of the left and right side of the patch 42. An additional first fastener 44C and second fastener 46C can be located in a lower portion of the left and right side of the patch 42. Each fastener may be attached to the patch using an attachment structure 48 as discussed in further detail above. Thus, in one exemplary embodiment as shown, the device 40 has three first fasteners 44A-C and three second fasteners 46A-C. Alternatively, the device 40 can have two first fasteners and two second fasteners, four first fasteners and four second fasteners, five first fasteners and five second fasteners, six first fasteners and six second fasteners, seven first fasteners and seven second fasteners, eight first fasteners and eight second fasteners, or any other number of first and second fasteners.

In use according to certain embodiments, multiple necklaces (not shown) may be attached to the multiple fasteners like those shown in FIG. 2 in a fashion similar to a single necklace attached to the device described above (e.g., as shown in exemplary FIG. 4), except that there are three necklaces in this specific implementation. A user may attach a necklace (not shown) to each set of first fastener 44 and second fastener 46, allowing the user to attach multiple necklaces. Each component of the fasteners 44, 46 may be located directly across from its corresponding component on the patch 42. When using a device 40 with three sets of fasteners 44, 46 (such as device 40 in FIG. 2), up to three necklaces (not shown) may be attached to such a device 40 when used by a user. The necklaces (not shown) attached to the device 40 may comprise different lengths. One necklace (not shown) may be attached to each set of first and second fasteners 44, 46.

In certain embodiments, except as expressly discussed herein, the other components and features of the device 40 can be the same or substantially similar to the components and features of the device 10 embodiment discussed above. In other words, the patch 42 can be the same or substantially similar to the patch 12 discussed above, including the adhesive on the contact face and/or the color or substitute metal on the outer face, the types of fasteners, etc.

Figure 3:
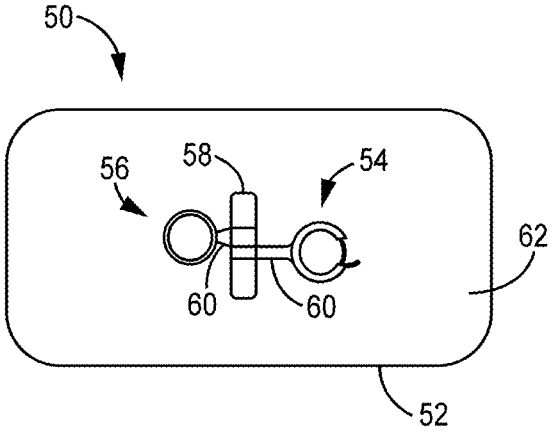
FIG. 3 is a front view of an embodiment of a jewelry clasp positioning device including a hinge, in accordance with one or more examples of this disclosure.

FIG. 3 shows a further alternative of the necklace clasp positioning device 50 wherein the first and second fasteners 54, 56 are disposed or attached to the outer face 62 rather than the sides of the patch 52. In one exemplary embodiment as shown, the fasteners 54, 56 are attached to an attachment body 58 that protrudes or otherwise extends from the outer face 62. The attachment body 58 in this implementation is located on the second face 62 of the device 50. In some embodiments, the attachment body 58 may be located at or near the center of the device 50. Alternatively, the attachment body 58 can be attached to the outer face 62 at any location on the patch 52. Some implementations of the device have multiple attachment bodies. Each of the multiple attachment bodies can be located at any location on the patch. The attachment body 58 may be gold, silver, or rose gold. In some embodiments, the attachment body 58 may be the same color as the fasteners 54, 56 and patch 52.

The attachment body 58 may comprise additional components. For example, the attachment body 58 as shown has two attachment extensions 60 that attach the first and second fasteners 54, 46 to the attachment body 58. Alternatively, the first and second fasteners 54, 56 are attached directly to the attachment body 58. In certain embodiments, the attachment body 58 can include a pivot, hinge, or other structure (not shown) to facilitate the movement of the first and second fasteners 54, 56. The hinge pivots about a hinge axis such that the first and second fasteners can pivot around the hinge axis. In alternative implementations including multiple attachment bodies, the multiple attachment bodies can each have a hinge, the hinge pivoting about a hinge axis.

Figure 4:
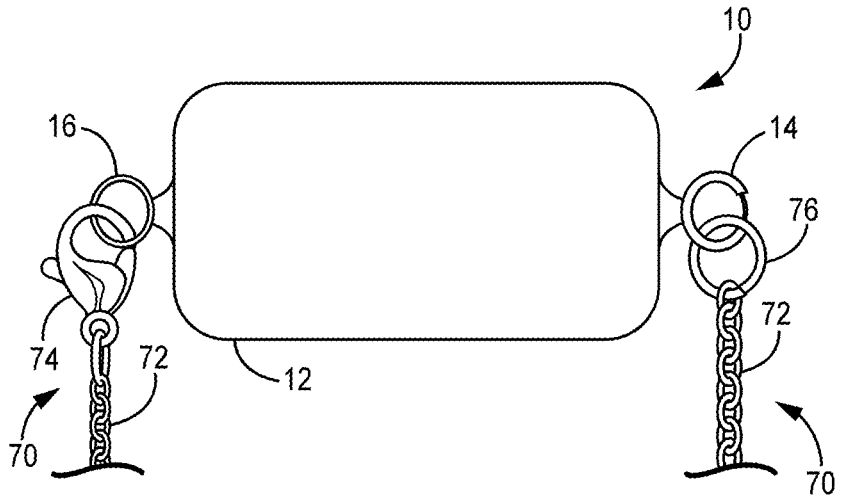
FIG. 4 is a front view of an embodiment of a jewelry clasp positioning device including a piece of jewelry, in accordance with one or more examples of this disclosure.

The fasteners 14, 16 (or any fastener embodiments disclosed or contemplated herein) are configured to allow for attachment of a standard necklace to the device 10. For example, in one embodiment as best shown in FIG. 4, the first fastener 14 of the necklace clasp positioning device 10 is attachable to the second fastener 76 of the necklace 70, while the second fastener 16 of the necklace clasp positioning device 10 is attachable to the first fastener 74 of the necklace 70. This attachment links both ends 74, 76 of the necklace chain 72 to the device 10, which is attached to a desired location on the user, thereby permitting the user to wear the attached necklace 70 in a stable fashion that prevents the two necklace fasteners 74, 76 from rotating in relation to the user's neck.

Figure 5:
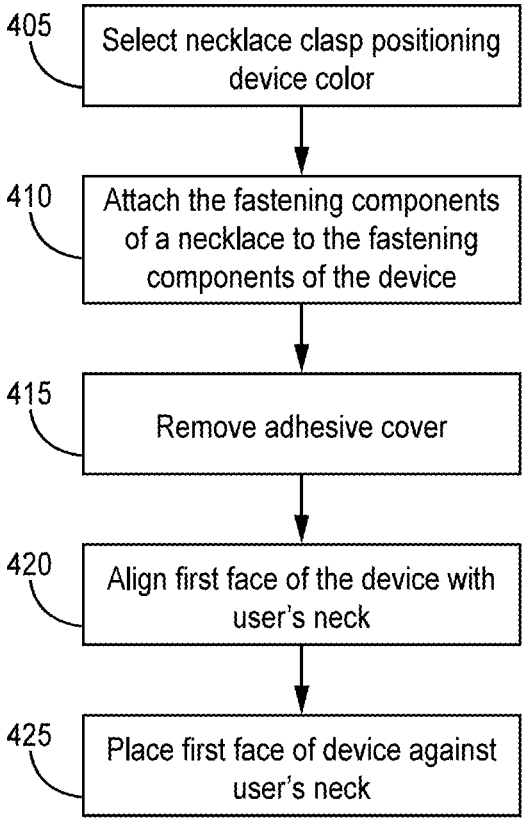
FIG. 5 is an embodiment of a method of use of a jewelry clasp positioning device, in accordance with one or more examples of this disclosure.

In use as best shown in FIGS. 4 and 5 according to one embodiment, a user can first select a clasp positioning device (such as any of device embodiments 10, 40, 50 herein) based on the color of the device (such that the color matches the necklace to be attached thereto) (block 405). Alternatively, the clasp positioning device can be selected based on any parameter or basis. Once the desired device is selected, the user can then attach a necklace 70 to the necklace clasp positioning device 10 by attaching the first and second fasteners 74, 76 of the necklace 70 to the first and second fasteners 14, 16 of the device 10 (block 410). The second fastener 76 of the necklace 70 may be attached to the first fastener 14 of the device 10, and the first fastener 74 of the necklace 70 may be attached to the second fastener 16 of the device 10. If a user desires to wear multiple necklaces, they may attach multiple necklaces to multiple fasteners using the device 40 of FIG. 2 or a similar device with multiple fasteners as discussed above.

Once the first and second fasteners 74, 76 of the necklace 70 are attached, the adhesive cover can be removed from the contact face (not shown) of the device 10 (block 415). Alternatively, in those embodiments in which the device 10 does not have an adhesive cover, the device 10 can be otherwise prepared for attachment. Then, the necklace clasp positioning device 10 is aligned with the user's neck at the desired location (block 420). At that point, the necklace clasp positioning device 10 is placed on the user's neck. Alternatively, the adhesive cover (not shown) can be removed after alignment of the device 10 in the desired location. The first face (not shown) of the necklace clasp positioning device 10 is then placed in contact with the desired location on the user's neck (block 425) such that the adhesive of the first face (not shown) of the device 10 adheres to the user's neck. When the device 10 is attached to the user's neck as desired, the device 10 is secured and will not substantially move from its position. The first and second fasteners 74, 76 of the necklace 70 then remain in place at the rear of a user's neck.

Alternatively, the steps taken to position the device on a user's neck may be completed in a different order. That is, in other methods of use, the necklace clasp positioning device 10 may first be oriented to the rear of a user's neck prior to attaching the necklace thereto. Then, the adhesive cover (not shown) may be removed and the necklace clasp positioning device 10 may be applied to the user's neck, which adheres the device 10 to the user's neck. The first and second fasteners 74, 76 of the necklace 70 can then be attached to the device 10 such that the device 10 ensures that the necklace fasteners 74, 76 remain in place in the desired location in relation to the user's neck (such as, in certain embodiments, the back of a user's neck).

Figure 6A:
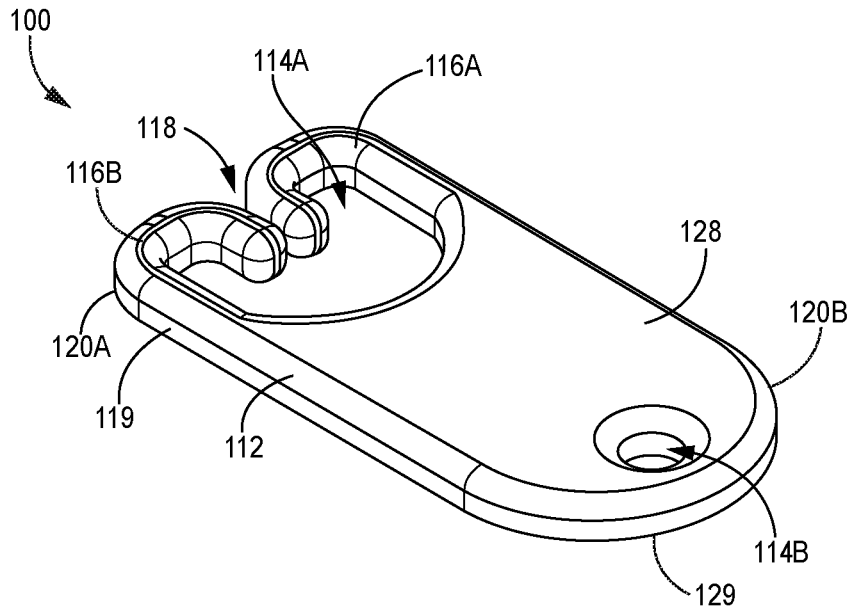
FIG. 6A is a perspective view of an embodiment of a jewelry clasp positioning device, in accordance with one or more examples of this disclosure.
Figure 6B:
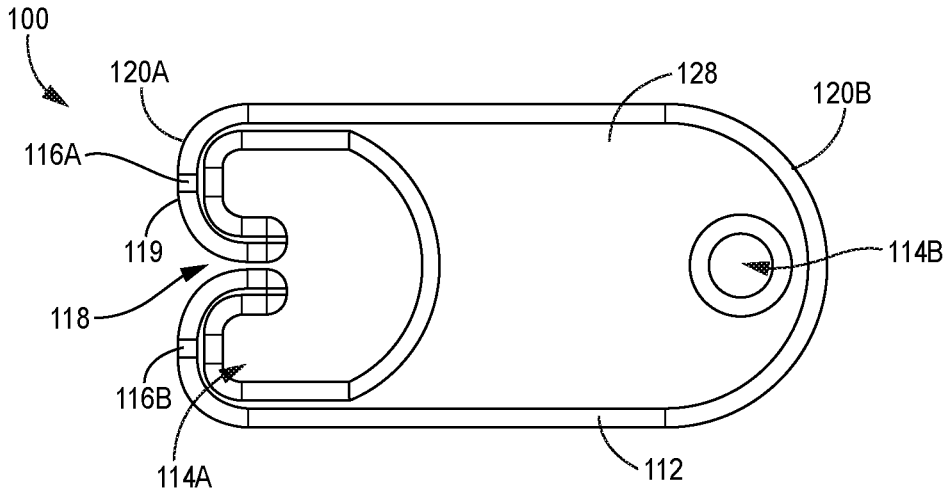
FIG. 6B is a top view of an embodiment of a jewelry clasp positioning device, in accordance with one or more examples of this disclosure.

FIG. 6A and FIG. 6B (collectively discussed herein as "FIG. 6") each show another embodiment of the jewelry clasp positioning device 100. The device 100 includes a patch 112 with a first face 128 and a second face 129. A first opening 114A and a second opening 114B can each extend from the first face 128 to the second face 129 and can be located at the first end 120A and second end 120B, respectively. Each opening 114A, 114B can be configured to receive a component of a jewelry clasp (such as the exemplary jewelry fasteners 74, 76 of FIG. 4). An adhesive layer can be disposed on the first face 128 or second face 129 of the patch 112.

The device 100 can include a variety of features. For example, the length of the device 100 can range from about 0.5 cm by about 3 cm and the width of the device can be about 0.25 cm to about 3 cm. Such dimensions are exemplary; the patch 112 can include lengths and/or widths that are larger or smaller than the dimensions listed herein. The device 100 can come in a variety of colors, such as gold, silver, or rose gold, and can be made of a variety of materials (e.g., metal or plastic). The patch 112 can be generally rectangular, and can include curved edges to prevent discomfort during use.

The first and second openings 114A, 114B include a variety of features. For example, the first and second openings 114A, 114B can have different shapes to receive various components of a jewelry clasp 74, 76. The second opening 114B can be generally circular. The first openings 114A can be formed by two hooks 116A, 116B curving toward one another. The width of each hook 116A, 116B can be half of the approximate length of the patch 112. The two hooks 116A, 116B can be adjacent one another such that a distance 118 exists between the two hooks 116A, 116B at the approximate center of the length of the patch 112. The distance 118 between the two hooks 116A, 116B can be wide enough such that a portion of a piece of jewelry and/or jewelry clasp component 74, 76 can pass therethrough. The distance 118 can be formed by any structure, including structures not including a hook. For example, in some embodiments, the distance 118 can be formed by a slot extending from the at least one of the openings 114A, 114B from the first face 128 to the second face 129 and to a perimeter 119 of the patch 112.

In use, a user can push a part of a piece of jewelry 70 and/or ring 76 of a jewelry fastener through the space 117 between the two hooks 116A, 116B. At least one of the two hooks 116A, 116B can be disposed through the ring 76, thereby positioning the ring 76 (and a portion of the jewelry fastener) on at least one of the hooks 116A, 116B. The clasp portion of a jewelry fastener 74 can be attached to the second opening 114B of the device 100.

This can facilitate the attachment of a piece of jewelry to the device 100 without having a user manipulate multiple small components (such as, for example, a lever that manipulates a spring clasp). This can improve the longevity of the device 100 while improving the ease with which a user can attach a piece of jewelry.

Figure 7A:
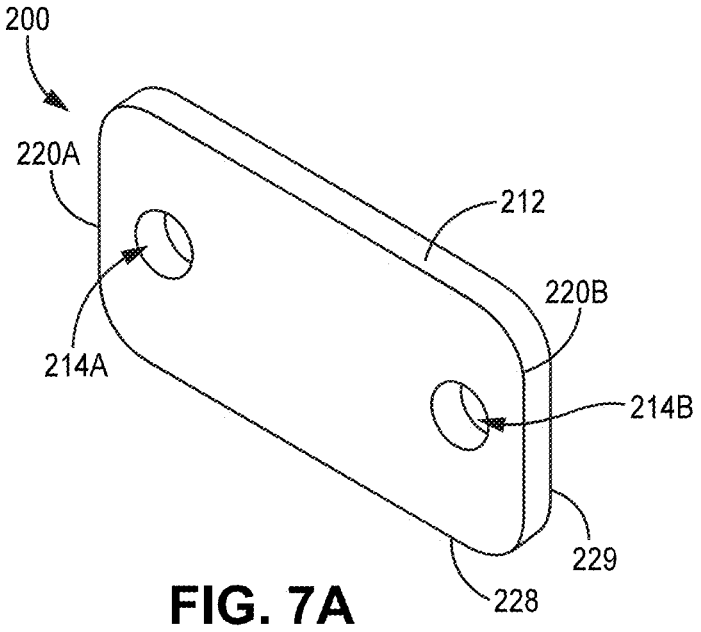
FIG. 7A is a perspective view of an embodiment of a jewelry clasp positioning device, in accordance with one or more examples of this disclosure.
Figure 7B:
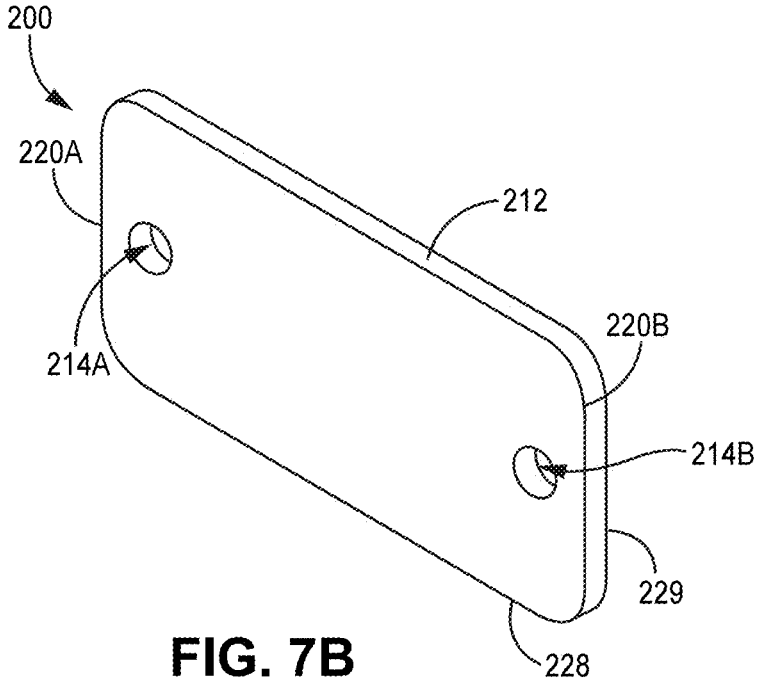
FIG. 7B is a perspective view of an embodiment of a jewelry clasp positioning device, in accordance with one or more examples of this disclosure.

FIG. 7A and FIG. 7B (collectively discussed herein as "FIG. 7") each show another embodiment of the jewelry clasp positioning device 200. The device 200 can be a patch including a first face 228 and second face 229 and two openings 214A, 214B each extending from the first face 228 to the second face 229. The openings 214A, 214B can be located at a first end 220A and second end 220B, respectively. The diameter of the openings can vary from about 1 mm to about 10 mm. FIG. 7A includes openings 214A, 214B with a diameter of about 1 mm. Such dimensions are exemplary; the diameter of the openings 214A, 214B can be larger or smaller than the diameters listed herein. FIG. 7B includes openings 214A, 214B with a diameter of about 2 mm. An adhesive layer can be disposed on the first face 228 or second face 229 of the patch 212. In some embodiments, the adhesive layer cab be disposed between the two openings 214A, 214B.

The device 200 can include a variety of features. As discussed above, the dimensions of the device 200 can range from a length of about 0.5 cm to about 3 cm and a width of about 0.25 cm to about 3 cm. Such dimensions are exemplary; the patch 112 can include lengths and/or widths that are larger or smaller than the dimensions listed herein. The device 200 can come in a variety of colors, such as gold, silver, or rose gold, and can be made of a variety of materials (e.g., metal or plastic).

In use, various components of a jewelry fastener can be attached to the two openings 214A, 214B in the patch. For example, fastener components such as a clasp 74 and/or ring 76 can be attached to each of the two openings 214A, 214B. The openings 214A, 214B can be configured to receive and/or be attached to any type of jewelry fastener.

Other embodiments of the jewelry clasp positioning device can include a ring formed by a rod comprising a first end and a second end. The ring can be configured to receive a jewelry fastener by passing the rod through the jewelry fastener from the first end to the second end. The rod can be wound circularly, similar to a key ring, such that one the jewelry fastener passes over the length of the rod, the jewelry fastener is attached to the rod. Other embodiments can include any structure or mechanism configured to couple with a jewelry clasp.

While the various systems described above are separate implementations, any of the individual components, mechanisms, or devices, and related features and functionality, within the various system embodiments described in detail above can be incorporated into any of the other system embodiments herein.

The term "about," as used herein, refers to variation in the numerical quantity that can occur, for example, through typical measuring techniques and equipment, with respect to any quantifiable variable, including, but not limited to, mass, volume, time, distance, wave length, frequency, voltage, current, and electromagnetic field. Further, there is certain inadvertent error and variation in the real world that is likely through differences in the manufacture, source, or precision of the components used to make the various components or carry out the methods and the like. The term "about" also encompasses these variations. The term "about" can include any variation of 5% or 10%, or any amount-including any integer-between 0% and 10%. Further, whether or not modified by the term "about," the claims include equivalents to the quantities or amounts.

Numeric ranges recited within the specification are inclusive of the numbers defining the range and include each integer within the defined range. Throughout this disclosure, various aspects of this disclosure are presented in a range format. It should be understood that the description in range format is merely for convenience and brevity and should not be construed as an inflexible limitation on the scope of the disclosure. Accordingly, the description of a range should be considered to have specifically disclosed all the possible sub-ranges, fractions, and individual numerical values within that range. For example, description of a range such as from 1 to 6 should be considered to have specifically disclosed sub-ranges such as from 1 to 3, from 1 to 4, from 1 to 5, from 2 to 4, from 2 to 6, from 3 to 6 etc., as well as individual numbers within that range, for example, 1, 2, 3, 4, 5, and 6, and decimals and fractions, for example, 1.2, 3.8, 1½, and 4¾ This applies regardless of the breadth of the range. Although the various embodiments have been described with reference to preferred implementations, persons skilled in the art will recognize that changes may be made in form and detail without departing from the spirit and scope thereof.

Although the various embodiments have been described with reference to preferred implementations, persons skilled in the art will recognize that changes may be made in form and detail without departing from the spirit and scope thereof.

What is claimed is:

1. A jewelry clasp positioning device, comprising:

(a) a patch comprising a first face, a second face, and a patch perimeter;

(b) an adhesive layer coupled to the first face;

(c) a first fastener operably coupled to the patch on a first side, the first fastener including a first slot extending from the first face to the second face at the patch perimeter; and (d) a second fastener operably coupled to the patch on a second side;

wherein the adhesive layer is configured to be placed on a user's skin and not be removed during use, wherein the slot is configured to receive a piece of jewelry therethrough.

2. The jewelry clasp positioning device of claim 1, wherein the adhesive layer is disposed on at least a portion of the first face.

3. The jewelry clasp positioning device of claim 1, wherein the first fastener and the second fastener are configured to attach to a jewelry fastener assembly.

4. The jewelry clasp positioning device of claim 1, wherein the first fastener and the second fastener are attached to an attachment structure protruding outwardly from a perimeter of the patch.

5. The jewelry clasp positioning device of claim 4, wherein the attachment structure is located on the second face of the jewelry clasp positioning device.

6. The jewelry clasp positioning device of claim 4, wherein the first fastener is attached to a first attachment structure attached to a first edge of the patch and the second fastener is attached to a second attachment structure attached to a second edge of the patch.

7. The jewelry clasp positioning device of claim 1, wherein the jewelry clasp positioning device is a color that can be selected from a group consisting of at least one of gold, rose gold, and silver.

8. The jewelry clasp positioning device of claim 1, wherein the patch comprises a flexible plastic.

9. The jewelry clasp positioning device of claim 1, further comprising at least three first fasteners and at least three second fasteners.

10. The jewelry clasp positioning device of claim 9, wherein the at least three first fasteners are each located on a first side of the device and the at least three second fasteners are located on a second side of the device.

11. The jewelry clasp positioning device of claim 1, wherein the first fastener comprises a first hook and a second hook each disposed adjacent to one another at a distance from one another forming the slot to facilitate movement of a jewelry clasp therethrough.

12. A jewelry clasp positioning device, comprising:

(a) a patch comprising:

(i) a first face;

(ii) a second face;

(iii) a first end; and (iv) a second end;

(b) an adhesive layer disposed on the first face;

(c) a first opening extending through the patch from the first face to the second face at the first end of the patch; and (d) a second opening extending through the patch from the first face to the second face adjacent to the second end of the patch and configured to receive a clasp of a piece of jewelry;

wherein the adhesive layer is configured to adhere to a user's skin during use, and wherein at least one of the first and second opening comprise a slot extending from the first face to the second face from at least one of the first and second opening to a perimeter of the patch.

13. The jewelry clasp positioning device of claim 12, wherein the adhesive layer is disposed on at least a portion of the first face.

14. The jewelry clasp positioning device of claim 11, further comprising a first device end and a second device end, and wherein the first end comprises a first hook and a second hook each disposed adjacent to one another at a distance from one another forming the slot to facilitate movement of a jewelry clasp therethrough.

15. The jewelry clasp positioning device of claim 14, wherein the first and second hook are configured to receive a jewelry clasp ring.

16. A method of using a jewelry clasp positioning device, comprising:

(a) selecting a color of the jewelry clasp positioning device, the jewelry clasp positioning device comprising:

(i) a patch including a first face, a second face, a first end, and a second end, wherein the first face comprises an adhesive layer;

(ii) a first opening extending through the patch from the first face to the second face at the first end of the patch; and (iii) a second opening extending through the patch from the first face to the second face adjacent to the second end of the patch and configured to receive a clasp of a piece of jewelry, wherein at least one of the first and second opening comprise a slot extending from the first face to the second face from at least one of the first and second opening to a perimeter of the patch;

(b) attaching at least one of the first and second fastening component of a piece of jewelry to the first opening and second opening of the device via the slot;

(c) removing an adhesive cover;

(d) aligning the first face of the jewelry clasp positioning device with a location; and (e) attaching the first face of the jewelry clasp positioning device to the location.

17. The method of claim 16, wherein the adhesive layer is disposed on at least a portion of the first face.

18. The method of claim 16, wherein the jewelry clasp positioning device further comprises at least three first openings and at least three second openings.

19. The method of claim 16, wherein the location comprises a user's neck.

20. The method of claim 16, wherein the first opening comprises a first hook and a second hook each disposed adjacent to one another at a distance from one another forming the slot, and wherein the method further comprises disposing one of the first hook or second hook through a jewelry clasp component by passing the jewelry clasp component through the slot.

* * * * *